United States Patent [19]

Rinck et al.

[11] Patent Number: 4,475,479

[45] Date of Patent: Oct. 9, 1984

[54] MACHINE FOR THE CONTINUOUS COATING OF A BODY OF REVOLUTION

[75] Inventors: Jean Rinck; Alain Lecomte, both of Mulhouse, France

[73] Assignee: Manufacture De Machines Du Haut-Rhin S.A., Mulhouse, France

[21] Appl. No.: 367,876

[22] Filed: Apr. 13, 1982

[51] Int. Cl.[3] ..... B05C 7/02

[52] U.S. Cl. ..... 118/707; 118/318; 118/319; 118/321

[58] Field of Search ..... 118/230, 232, 219, 668, 118/707, 318, 306, 319, 321, 322, 409, 622; 134/66, 78–80, 134, 152; 15/97 R

[56] References Cited

U.S. PATENT DOCUMENTS

| | | | |
|---|---|---|---|
| 2,547,884 | 4/1951 | Paasche | 118/318 |
| 3,062,177 | 11/1962 | Henrickson | 118/322 X |
| 3,989,001 | 11/1976 | Brigham et al. | 118/322 X |

*Primary Examiner*—John P. McIntosh

[57] ABSTRACT

The present invention relates to a machine for the continuous treatment of a body of revolution. Treatment stations are provided on the periphery of a rotatable drum. The machine comprises at the location of the zone of treatment a continuous guiding belt driven by a prime mover. On one side or the other of such belt, or on both sides thereof, there are disposed elements constituting a fixed guiding guard. The drum drives the bodies of revolution which are to be treated, in rotation by friction as they pass along the guard and the belt, the treating operation being effected when the treatment stations and the bodies pass through the zone of treatment. The bodies can themselves turn, if the drum is stopped, by friction between them and the movable belt, in order to avoid defects in varnishing or other similar treatments in case of breakdown of the driving of the drum. The apparatus is particularly useful in the continuous varnishing of bodies of revolution.

12 Claims, 6 Drawing Figures varnishing zone
Elevation of the varnishing nozzles
Descent of the varnishing nozzles
78
76
V1+V2
V1
16
18
22
24
10
72
74
Entrance zone
Exit zone
I

MACHINE FOR THE CONTINUOUS COATING OF A BODY OF REVOLUTION

The present invention relates to the treatment of a body of revolution on a continuously working machine, such machine incorporating a barrel upon which the work pieces are fed in regular succession, each piece entering into a treating station, undergoing a treating operation during one part of the rotation of the drum, and being discharged in regular succession after treatment.

The treatment contemplated according to the invention is essentially a varnishing or japanning operation, but it could relate to other operations, and even to a final machining operation.

The invention will be described more precisely in connection with the varnishing or japanning of the interior of cartridge cases, but it is useful in other cases of coating the interior or exterior of bodies of revolution, and particularly where it is necessary to have precise tolerances on the quality, such as uniformity of thickness, of the coating.

It has already been proposed to provide machines in which the body of revolution is maintained in orientation and position and is caused to rotate about its own axis, by the simple friction of the work piece, against a stationary guide or guard, such piece being rotatably driven by the rotation of the drum. Such rotation of the work pieces around their own axes assures a good uniformity of the thickness of the coating of varnish; however, such machines are not entirely satisfactory.

In particular, such machines have not solved, in a satisfactory manner, the problems which arise due to the stopping of the machine which are frequently posed in the continuous treatment. Such stoppages may be due to a breakdown of the means for driving the machine, or even those voluntarily arising due to maintenance of the machine, or due to a modification of the control of the machine, or even the correct repositioning of one of the work pieces on the machine.

It will be satisfactory if the work pieces which are in the course of treatment, at the moment when the drum stops, continue to carry out, up to the end, the operation which has been commenced, or even if they are stopped before the operation has been commenced; in all events, it is necessary to avoid having to discard work pieces which have been incompletely treated because they have been stopped during the treatment and cannot be retreated at an intermediate point.

The problem thus posed occurs very frequently in the case of varnishing or japanning: if this operation is performed incompletely upon a work piece because of the stopping of the drum in a position such that the work piece is in the course of being coated, there is a risk that the varnish may dry upon the work piece as well as upon the varnish injection nozzle so that the operation cannot be resumed without discarding the partially coated work piece.

The present invention overcomes the above-outlined problem by providing a machine in which at least in a part of the treatment zone the work piece is rotated about its own axis by frictional engagement with an endless driven band or belt, such a belt being driven by a separate prime mover, so that even if the drum stops, the work piece continues to turn about its own axis by reason of friction between it and the belt.

More precisely, the continuous treating machine according to the invention comprises a rotatable drum provided on its periphery with a plurality of stations for receiving work pieces in the form of bodies of revolution and of treatment stations each corresponding to a work piece receiving station and spaced angularly about the periphery of the drum. At least in one part of the treatment zone, the guiding guard is constituted by an endless belt which substantially follows the periphery of the drum and drives the body of revolution for rotation about its axis by the action of friction even if the drum stops.

The treatment stations are controlled in such manner as to carry out the treatment operation while it is situated in the treatment zone; the treatment zone forms a fixed angular sector disposed around the drum, such sector being located between an infeeding zone wherein the unvarnished work pieces are received and a zone for discharging varnished work pieces. The work pieces are mounted in such manner that they are freely turned about their axes, with respect to the drum, so that they can be rotated upon themselves by the friction of engagement with the guiding guard.

Thus, in normal operation, the treatment being carried out, for example, varnishing, is effected uniformly with a constant rotation of the work pieces under the conjoint effect of rotation of the drum and of the movement of the belt; if the drum stops, the varnishing operation is still carried out uniformly by virtue of the rotation of the pieces about their own axes due to the action of the movable belt.

The manner and the speed of driving of the movable belt can be determined as a function of the requisite precision for the length of deposition of the varnish.

In the case in which the length of deposition of the varnish is not required to be of very great precision, it will suffice that the belt is driven at a speed such that when the drum is stopped, it drivingly rotates the bodies of revolution about their own axes at an angular speed in the neighborhood of that at which they are driven by the drum turning at its normal speed, without, however, increasing the speed of the belt too much.

If the length of the deposition of the varnish needs to be more precise, one can provide two speeds of driving of the belt:

a slow speed when the drum is rotating, a rapid speed when the drum is stopped, in such manner as to obtain the same speed of rotation of the work piece with respect to the drum in both of such cases.

A control logic device assures the automatic passing from slow speed to rapid speed when the drum is stopping from its normal motion, and vice versa.

If the precision of the length of deposition of varnish must be very carefully controlled, there is then used a slave drive for the driving of the belt permitting its speed to remain constant, as a function of the speed of rotation of the drum, even during the phases of acceleration or deceleration of the drum, or its slowing down preliminary to its stoppage, or during the slower phases of its motion, for example, for the control of the treating machine.

Such driving permits the speed of rotation of the work piece with respect to the drum to be independent of the rotation of the drum and yet to be constant with respect to the treating station.

One manner of carrying out such slave drive consists in utilizing a differential gearing mechanism having:

a main or drive shaft which is driven independently of the drum, on a first branch shaft of the differential, there is mounted a driving pulley for the belt, a second branch shaft which is drivingly connected for rotation with the drum.

If the drum slows or is stopped, the differential branch shaft which is connected to the drum also stops, and the other branch shaft, which carries the pulley for driving the belt, accelerates or turns at twice its normal speed, thus compensating exactly completely and automatically for the variations in speed of the drum and permitting a rigorously constant speed of rotation of the work piece around its own axis to be maintained irrespective of the speed of the drum.

Other characteristics and advantages of the invention will appear in the detailed description which follows and by reference to the attached drawings in which.

Figure 1:
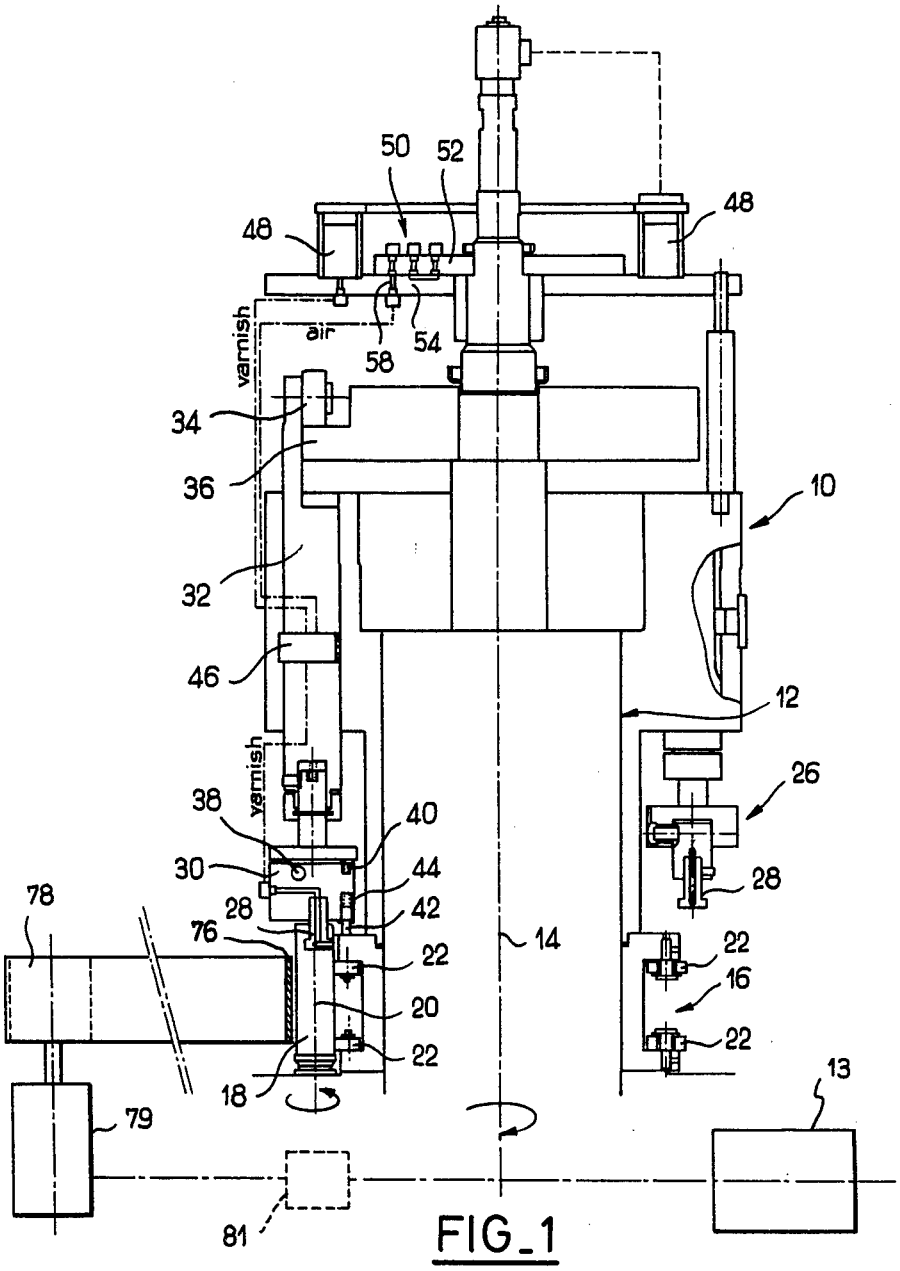
FIG. 1 is a view in vertical broken axial section through a first embodiment of continuous varnishing machine to which the present invention is particularly applicable, the section being taken along the line 1—1 in FIG. 3.

Turning first to FIGS. 1–5, incl., the continuous varnishing machine there shown comprises a continuously rotating drum 10 mounted upon a shaft 2 having an axis of rotation 14 by a schematically illustrated driving mechanism B. The drum carries on its periphery a plurality of uniformly angularly spaced stations 16 for receiving work pieces 18; each station 16 is adapted to receive a work piece and to maintain it in a predetermined position and orientation during the rotation of the drum.

The work pieces 18, which are adapted to be received in the station 16, are bodies of revolution and are oriented in the station with their axes 20 parallel to the axis 14 of the drum. The work pieces 18 are fed into the station 16 against idle guide rollers 22, rollers 22 having their axes parallel to the axis of the drum. The rollers 22 define the radially inner limit of the station 16, and the bodies of revolution 18 can turn freely while remaining in contact with the idle rollers 22.

Figure 3:
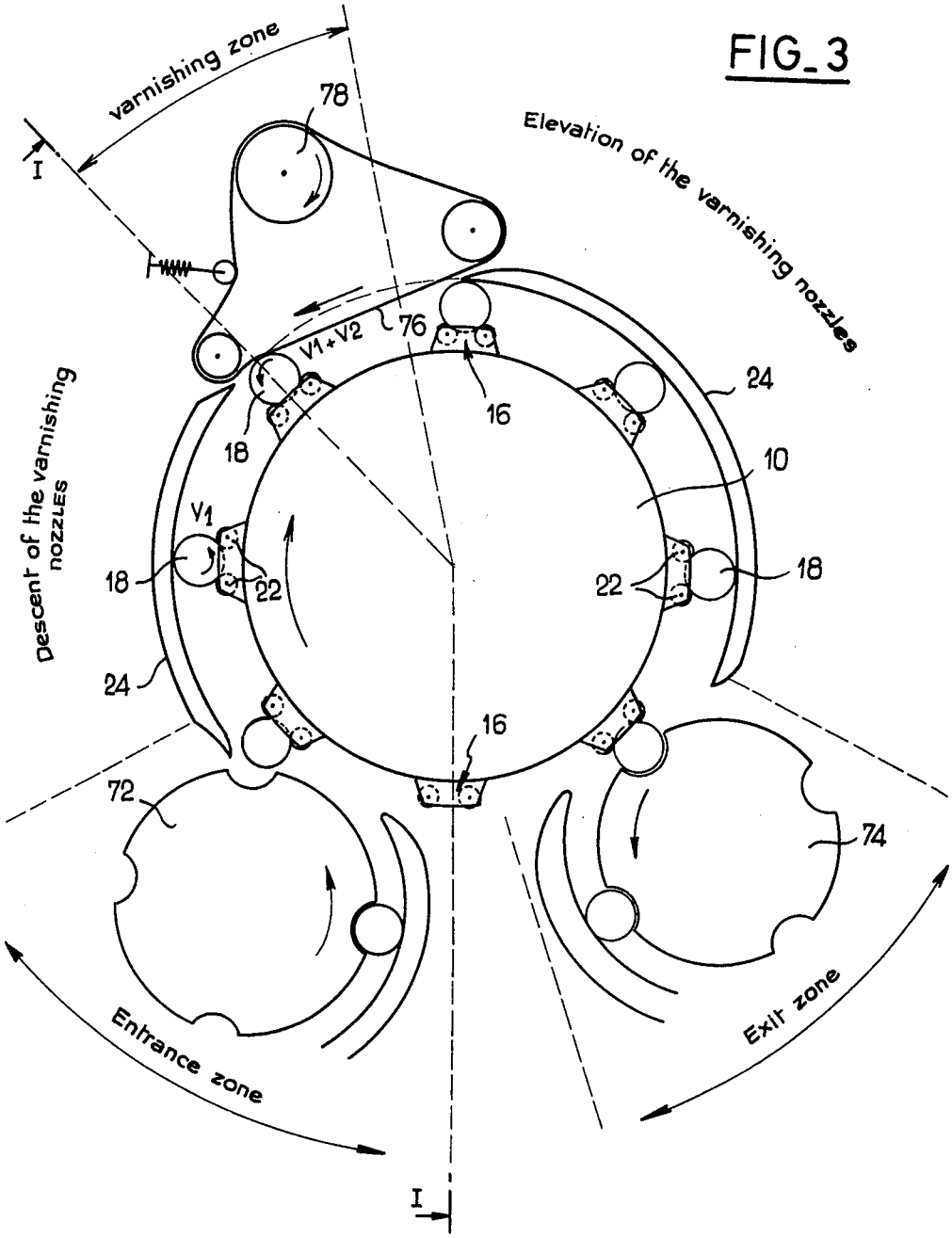
FIG. 3 is a schematic horizontal view showing how the work pieces are fed to the stations on the drum, are rotated at the varnishing zone, and are discharged from the drum.

The radially outer limit of the station 16 is constituted by a guide or guard 24 which extends partially around the drum and insures that the work pieces 18 do not escape radially outwardly from the station 16 as they travel with the drum. The guiding guard 24 is fixed, that is to say, it does not turn with the drum. As shown in FIG. 3, guide 24 is interrupted at the position of the entrance zone of the work pieces, where they are fed into their stations on the drum, and is also interrupted at the zone at which they are treated, that is varnished, and also at the zone at which the work pieces are discharged from the drum after having been varnished. As shown in FIG. 3, the work pieces 18 remain in engagement with the rollers 22 and thus maintain the same position radially with respect to the axis of the drum as they travel thereabout.

The work pieces 18 are uniformly spaced around the drum 10 in the stations 16 on the drum; the positioning and the orientation of the work pieces 18 are assured by the idle rollers 22, as regards the radial distance of the work pieces from the axis of the drum, and by the guiding guards 24 which maintain the work pieces in engagement with the rollers 22.

The zone of the drum 10 which lies between the zone of entry of the work pieces and the zone of discharge of the work pieces from the drum, in the direction of rotation of the drum, is a work zone in which there is provided a zone which is here called the varnishing zone, a non-limiting denomination, that is to say, the zone at the level of which the work pieces are treated; in the case of the application of varnish, varnishing applying nozzles, which are described more in detail in the following part of the description, are introduced into the work pieces at the entrance to such varnishing zone, and they are retracted from the work pieces before such work pieces are discharged from the drum.

In the construction shown, the introduction of the work pieces to the drum, and the discharge of the work pieces from the drum, are accomplished with the aid of an entry wheel 72 having uniformly angularly spaced work piece receiving scallops in the edge thereof, and a similar discharge wheel 74, both the wheels 72 and 74 being disposed at the level of travel of the work pieces 18. The rotation of the drum 10 causes a rolling of the work pieces 18 upon the guiding guard 24 with an angular speed of V1. The apparatus of the invention avoids the situation wherein the work pieces 18 disposed in the varnishing zone are submitted to a non-uniform treatment because they are stopped from turning by stoppage of the drum 10, so that their treatment is unfinished.

To overcome such inconvenience, in accordance with the invention as shown in the embodiment depicted in FIG. 3, there is provided in the varnishing zone proper a system independent of the rotation of the drum which assures the rotation around their own axes of the work pieces 18 by a movable endless belt 76 following approximately the peripheral path of the guiding guard 24 in such manner as, in effect, to extend it into the varnishing zone, the guard itself being terminated at the positions of the entry and exit ends of the varnishing zone. The work pieces 18 come into engagement with the belt 76 at the varnishing zone so that they are driven by the belt in the varnishing zone. The belt 76 is an endless belt driven in rotation by driving means 78 such as a motor 79; it exerts a frictional drive upon the work pieces 18 located in the varnishing zone such that if the drum 10 is stopped, a work piece 18 disposed in the varnishing zone will be driven in rotation about its own axis by the belt 76 with a speed V2 (rolling without slippage of the piece 18 upon the belt 76).

Thus in the case of the stoppage of the drum 10 when the treating of a work piece 18 has already been commenced at the treating zone, the injection of varnish into a work piece driven in rotation about its own axis is assured with the same uniformity of treatment as it would if the drum were turning. It is to be understood that the treatment is terminated at the end of a predetermined length of time by a timer 66 which will be described with reference to FIG. 2.

It is suitable that the speed of rotation of the work pieces 18 about their own axes situated in the varnishing zone are of the same order of magnitude in the case when the drum is stopped as it is in the case in which the drum is rotated at its normal speed. Such normal speed of rotation of the drum is predetermined; it is then necessary to choose the speed of movement of the belt 76 according to certain conditions to have a speed of rotation of the work pieces 18 around their own axes in the varnishing zone which is acceptable in all cases: such speed of rotation of the work pieces 18 about their own axes in the varnishing zone is equal to V1 plus V2, or V1 can vary between zero and the speed of rotation of the work pieces 18 which is determined only by the rotation of the drum 10; V2 is the predetermined speed of the piece 18 about its own axis caused by the movement of the belt 76.

In fact, if V1 is composed of the predetermined speed of the work pieces by the drum 10 itself, assuming that the drum turns at its normal speed and that it cooperates with the frictional guard 24, and if V2 is the resultant of the predetermined speed imposed upon the body 18 by the frictional band or belt itself only, assuming that the drum 10 has stopped, one can say that the speed of rotation of the work pieces 18 in the varnishing zone lies in a range comprised between V2 and V1 plus V2 (drum and belt tending each independently to turn the work pieces 18 in the same direction) or between V2 and V2 minus V1 (drum 10 and belt 76 acting in the opposite direction, that is to say, that the direction of travel of the belt and of the drum in the varnishing zone will be identical).

The relationship (V1 plus V2)/V2 in the first case, or V2/(V2−V1) in the second case must have a value near 1, or while adapting a reasonable speed for the movement of the frictional belt 76, since in theory it is necessary that the speed V2 be very great due to the travel of the belt to attain the above quantity above 1.

In practice, one will utilize the first case which gives a resultant of speed more nearly 1 for the same speed of driving of the belt, and one will choose V2 at least equal to V1 to have a smaller relationship or equal to 2 between the speeds of rotation of the work piece 18 in the normal travel of the drum 10 and in the case of the stopping of the drum, all while maintaining a moderate speed of movement of the belt 76 and of the rotation of the work pieces 18 around their own axes. It will not be suitable in effect to have a speed of rotation of the pieces around their own axes which is too high.

It is to be understood that one can freely increase or decrease the value V2, the normal speed of the drum 10 being predetermined, to establish a compromise between the maximum suitable speed of rotation of the work pieces 18 and the speed of rotation thereof in the presence or in the absence of rotation of the work pieces 18 of 1.5 times $V_1$, one will take $V_2$ as being greater than $V_1$ and less than or equal to 1.5 $V_1$ and one will drive the drum 10 and the belt 76 in the direction opposite from the direction of rotation of the work pieces 18, or V2 is less than or equal to 0.5 times V1 while making the drum 10 and the belt 76 move in the same direction. Thus the relationship of the speeds of rotation of the work pieces 18 in the absence or in the presence of rotation of the drum 10 will be 3.

In addition it is to be understood that the inversion of the rotary motion of the work pieces 18, which can eventually occur, takes place outside the properly so-called varnishing zone.

If one does not wish to exceed 2 for this result, one can choose a speed of travel of the belt 76 such that V2 is greater than or equal to V1 (with the same direction of movement of the belt 76 in the drum 10) or V2 is greater than or equal to 2 V1 (contrary direction).

It will be seen that what has been described above is an example of compromises to be adopted when taking V2 equal to V1 with a direction of movement of the belt 76 opposite to that of the drum 10 (belt and drum then moving in the same direction as the rotation of the work pieces 18 ); in effect, in the case in which a good relationship between the speeds of rotation of the pieces 18 with and without rotation of the drum 10 one can avoid turning the pieces 18 at too high a speed (a maximum speed of 2 V1). Another compromise would be to make V2 equal to 2 V1 with movement of the belt 76 in the same direction as that of the drum; one will obtain the same results as those above, but this necessitates a speed of movement of the belt which is twice that normally employed.

It is to be understood that the exact calculation of speed of movement of the belt 76 depends upon the diameter of the work pieces 18, as well as upon the diameter of the drum 10, if the calculation is made on the basis of the speed of rotation of the drum 10.

According to another manner of driving the movable belt 76, a command logic means schematically shown at 81 detecting the stopping and the starting of the drum 10 assures the automatic passage of the speed of driving of the belt 76 between a slow speed when the drum 10 is rotating, and a rapid speed when the drum has stopped in such fashion as to obtain the same speed of rotation of the pieces 18 with respect to the drum 10 in such two cases.

Figure 4:
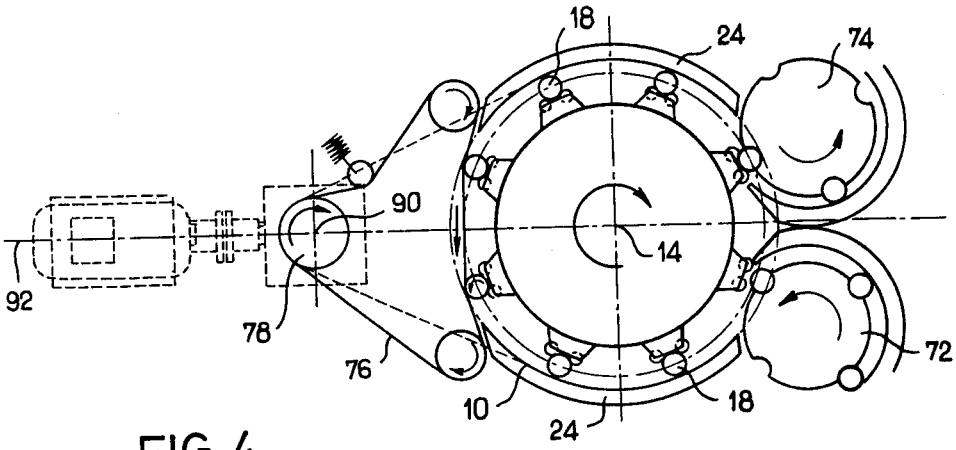
FIG. 4 is a view from above the drum of the machine showing the means for rotating the work piece to assure a constant speed of their rotation with respect to that of the drum.
Figure 5:
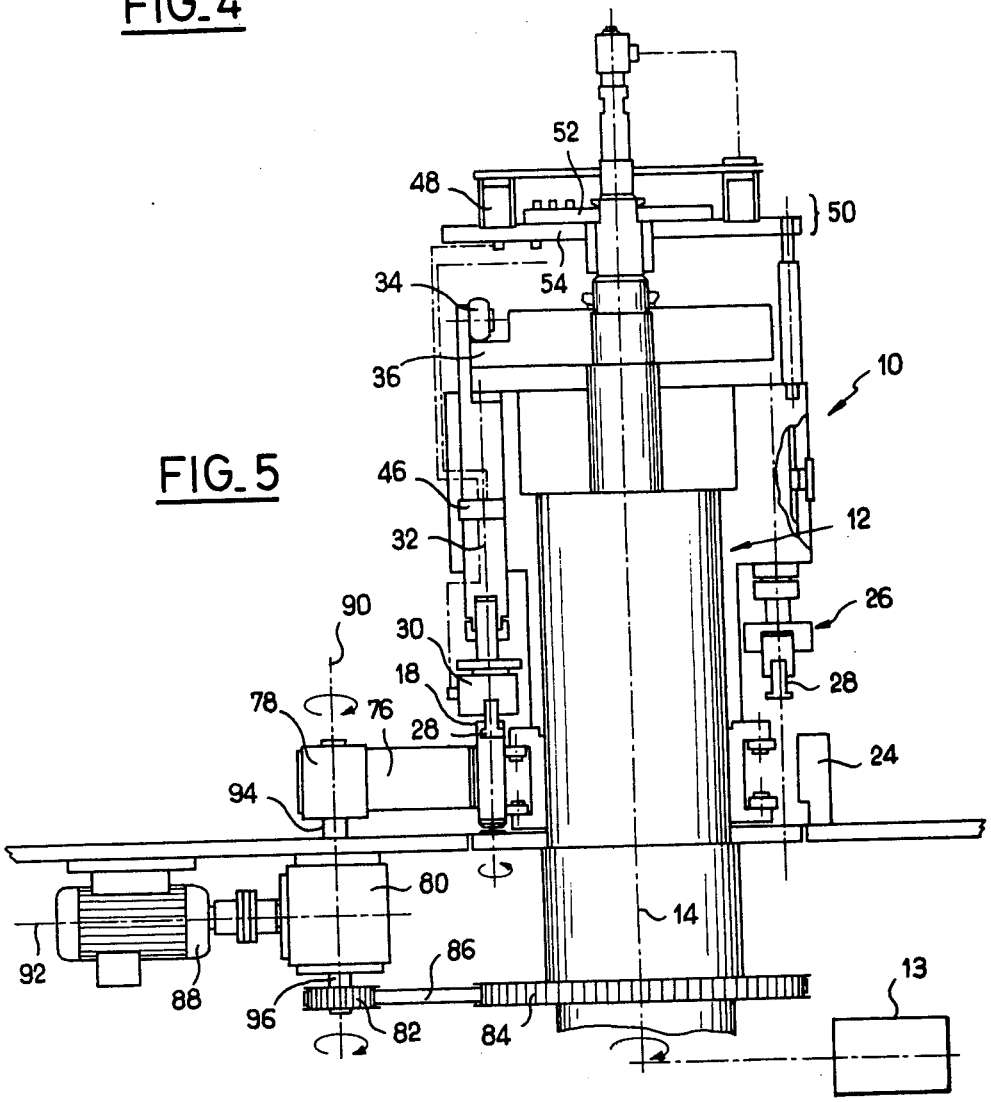
FIG. 5 is a view in side elevation of the machine shown in FIG. 4.

In FIGS. 4 and 5, there is shown respectively a view from above and a schematic side elevation of a machine according to the invention comprising slave control means to render the speed of rotation of the cartridge cases 18 with respect to the drum 10 independently of the speed of rotation of such drum.

Such slave means shown in this figure constitutes a mechanical slave arrangement, well understood, which can easily be replaced by any appropriate electronic slave mechanism.

A driving motor 88, independent of the motor 13, is disposed on the axis 92 of the main driving shaft of a differential gear mechanism 80 and is connected to it. Such differential mechanism 80 is also disposed on the axis 90 of the wheel 78 for driving the belt 76, the driving wheel 78 being mounted on a first branch shaft 94 of the differential mechanism 80.

A wheel 82 is mounted upon the second branch shaft 96 of the differential mechanism 80 and is connected for rotation to the drum 10 by the intermediary of a driving means which can be, for example, formed by a cogged belt 86 and a cog wheel 84 connected to the drum 10, the speed of rotation of the first branch shaft 94 is thus a function of the speed of rotation of the motor 88 and of the second branch shaft 96.

Such mounting permits the speed of driving of the belt 76 to be correlated with and varied with the speed of rotation of the drum 10.

In choosing, in an adequate manner, the dimensions of the wheel 78, 82 and 84, one takes into account the speed of rotation of the work piece 18 with respect to rotation of the drum 10, or one makes the speed of rotation of the work piece independent of the speed of rotation of the drum, as will be demonstrated below.

In effect, the symbols utilized hereinafter have the following meanings:

$D_G$=diameter of rolling of the cartridge case 18 upon the guiding guard 24, d=diameter of the cartridge case 18, $D_1$=diameter of the wheel 78, $D_2$=diameter of the wheel 82, $D_B$=diameter of the wheel 84, $\omega_M$=speed of rotation of the driving motor 88, k=ratio of reduction of the differential mechanism 80, $\omega_b$=speed of rotation of the drum 10, $V_B$=linear speed of the belt 76, $\omega_{d/B}$=speed of rotation of the cartridge case 18 with respect to the drum 10.

One then has the following relations:

$$\omega_{d/B}=(1/d)D_1\omega_M/k+(D_G-(D_BD_1/D_2))\omega_B$$

wherein:

$$(D_B/D_2)=D_G/D_1$$

when $$\omega_{d/B}=\text{a constant}=\omega_M D_1/kd$$

One can see from such relation that the above equation is fulfilled, in particular, when the wheels 78 and 82 have the same diameter and the wheel 84 has a diameter equal to the interior diameter of the guarding guide 24 about the axis of the drum 10.

If this condition is complied with, the value of the speed of rotation of the cartridge case 18 with respect to the drum 10 is uniquely a function of the values of d, $D_1$ and k. Further, the linear speed $V_B$ of the belt 76 is given by the following equation:

$$V_B=\pi(\omega_M D_1/k-\omega_B D_G)$$

The values of k (the amount of reduction of the differential mechanism 80) can be easily determined as functions of each particular case.

The treatment stations shown in FIG. 1, employed for the treatment of the work pieces 18 will now be described in more detail.

The machine shown in FIG. 1 permits the treatment of cartridge cases to varnish an annular interior portion which serves as a connecting joint between the projectile and the interior surface of the cartridge case in order to seal the interior of the cartridge case from the atmosphere.

The treating machine shown in FIG. 1 comprises, at the position of each station 16, a varnishing mechanism 26 which is adapted to effect a varnishing operation on each work piece 18 present at the corresponding station 16. The work piece 18 can be conveniently introduced into such station so that the operation of varnishing can commence; such operation requires a certain amount of time corresponding to a rotation of the drum 10 through a given angle so that the work piece 18 is displaced through a certain angular zone which we will call the varnishing zone and which is always the same, with respect to a fixed datum line or reference point, for all of the work pieces 18 carried by the drum 10, that is to say independent of the angular position of the same. Such varnishing zone can correspond, for example, to a sector having a central angle of about 35°. A cam system fixed with respect to the drum 10, as well as electric and pneumatic mechanisms, controls the course of operation of the machine in a repetitive manner so that at each passage of a station a work piece 18 through the varnishing zone the interior of the work piece is coated with varnish, as above described.

In the embodiment shown, each varnishing mechanism 26 comprises a varnishing nozzle 28 capable of being introduced into the interior of the hollow work piece 18, the nozzle having a varnish discharge orifice which discharges varnish against the interior wall of the work piece 18 after the nozzle is introduced into such work piece. The varnish nozzle 28 is carried by a supporting block 30 which can be displaced vertically parallel to the axis of the drum 10 in order to introduce the nozzle 28 into the work pieces 18 when the work piece is properly positioned. The block 30 is connected to a shaft 32, the upper end of which carries a wheel or roller 34 which travels over a fixed circular path 36 on the cam which reciprocates the cam follower roller 34 and thus imparts a vertical reciprocation to the varnishing nozzle 28 so that the nozzle first enters the cartridge case 18 and then after a certain time is retracted from it. It can be seen that the block 30 is mounted on a transverse axial 38 stub shaft around which it pivots slightly. A first coil compression spring 40 tends to pivot the block 30 into a position facilitating the introduction of the nozzle 28 into the work piece 18, and a pushing finger 42 thrust by a coil compression spring 44 pivots the block 30 in the opposite direction, after the introduction of the nozzle 28, to a position in which the nozzle is applied against the interior surface of the cartridge case 18. The pushing finger 42 is supported by a part firmly affixed to the drum 10 to push the block 30 against the force exerted thereon by the spring 40. The elasticity of the spring 44, which is stronger than the spring 40, permits the nozzle 28 to be pushed with a uniform force against the interior surface of the cartridge case 18.

Figure 2:
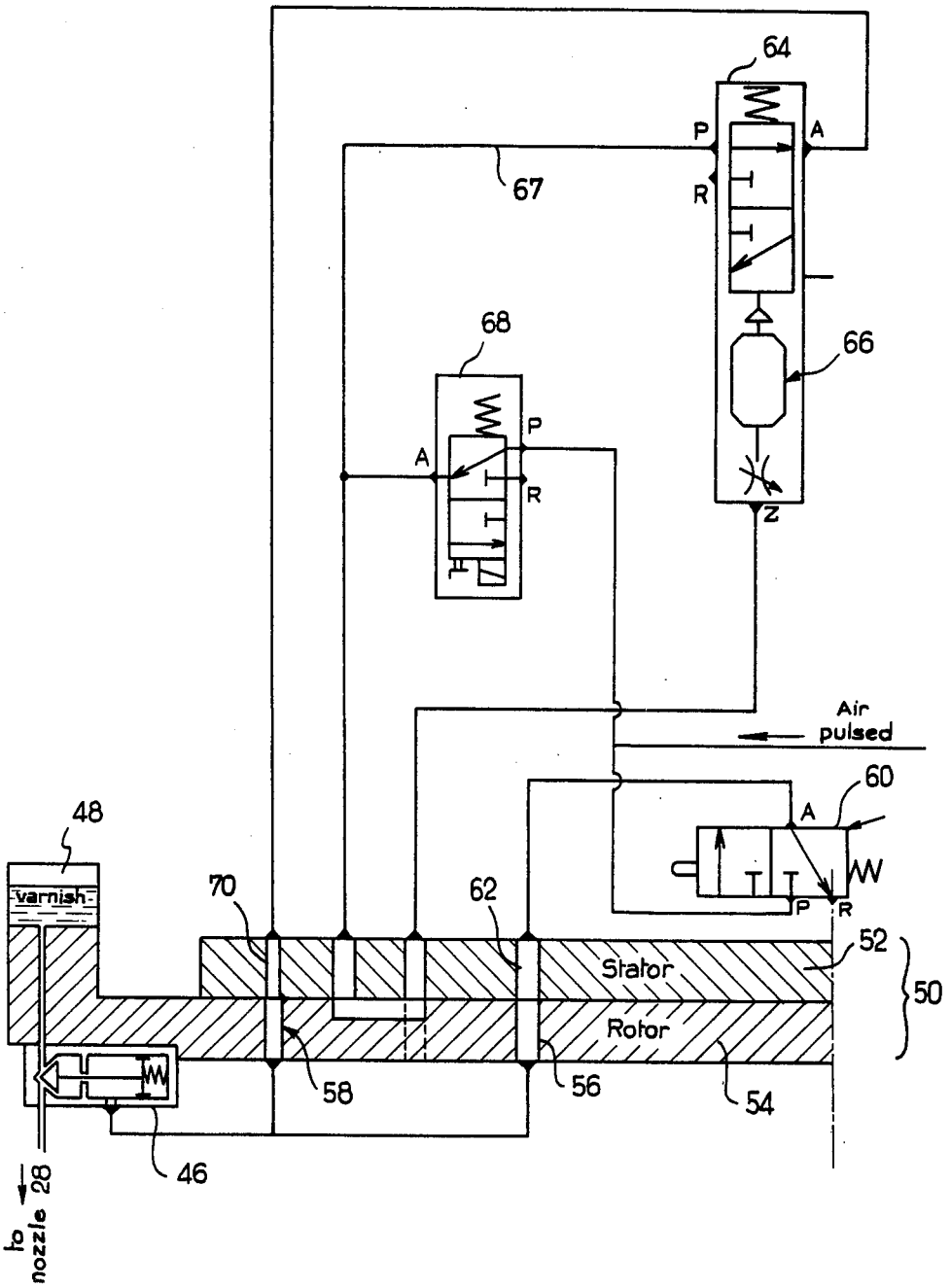
FIG. 2 is a schematic layout showing pneumatic circuits which control the dispensing of varnish to the varnishing stations on the drum.

An example of the layout of the system for the distribution of varnish in a sequence to the varnishing mechanisms 26 is shown in FIG. 2.

The admission of the varnish into each of the nozzles 28 is caused by a pneumatic valve 46 (there being a valve 46 for each varnishing mechanism 26) such valve receiving varnish from an annular reservoir 48 which is disposed on a part disposed above the drum 10 and which turns with it, the reservoir being able to be placed under pneumatic pressure to facilitate the flowing of the varnish to the varnish nozzle. The valve 46 is controlled by the arrival of a pulse of air under pressure which is provided by a rotary distributor 50 comprising a fixed part or stator 52 and a part or rotor 54 connected to rotate with the drum 10. Each of parts 52 and 54 comprises portions of air conduits which extend partially radially with respect to the axis of the drum 10 and partially circumferentially thereof. The positioning of the different conduits with respect to each other in the course of the rotation of the drum defines a certain sequence of distribution of air under pressure to the various valves 46. In particular, a valve 46 is fed with air under pressure for a time predetermined by the duration of communication between one conduit of the stator and the corresponding conduit of the rotor, such duration of communication corresponding, for example, to the length of opening of a conduit of a fixed part or a movable part of members 52, 54 with respect to the conduit of the other part. The zone of varnishing proper is defined by the zone during which each valve 46 is opened to allow the passage of varnish from the varnish reservoir 48 to the respective varnish nozzle 28.

In the embodiment shown, the pulses of air under pressure are delivered to the fixed part of the rotatable distributor 50. At the position of each varnishing mechanism 26, openings 56 and 58 provided in the rotor 54, which are connected to the pneumatic control of the valve 46 of such mechanism, assures a double command of the same, one command being a manual command for purging the varnishing nozzle during the stopping of the machine, and the other command being a cyclical command during the normal functioning of the machine.

A conduit 56 communicates with a manually operated valve 60 connected to a source of air under pressure. This communication is effected by the intermediary of a conduit 62 in the stator 52, the duration of communication between the conduits 56 and 62 being sufficient to assure the purging of the varnish from the nozzle, such purge being effected only if the valve 60 is operated.

A conduit 58 communicates with the exit of a distributor valve 64 which is operated at predetermined times by a pneumatic timer 66 which is regulated to assure an injection of varnish through a given nozzle during a predetermined period in each cycle. The valve 64 receives air under pressure through a conduit 67 providing at the exit of a distributor valve 68 which is electrically operated and receives air from a source under pressure. The distributor 68 furnishes a pulse of air under pressure also to the valve 64 as well as to the pneumatic timer 66, but for the latter, the connection is made by way of the distributor 50 so as to unlatch the timer 66 by a short impulse of air under pressure, at a precise instant, such unlatching having for its effect the opening of the valve 64 which remains open until the end of the proper time period determined by the timer 66. The valve 64 being open, it receives air under pressure which is transmitted through the conduit 58 connected to the valve 46, such transmission taking place only when the distributor 50 connects the conduit 58 to the conduit 70 connected to the exit end of the valve 64.

The electrically activated distributor valve 68 is activated only under certain conditions, in particular only if a work piece 18 is present in a receptacle or station which is positioned at the varnishing station; if such piece is absent, the impulse to unlatch and open the valve 64 is not given, the distributor 68 remaining closed. The control responsive to the presence or the absence of a work piece 18 can work either upon the drum 10 before the introduction of the work pieces 18, and the opening of the distributor 68 is carried out in a manner which is synchronized with the detection of the work piece 18, with eventually an appropriate displacement carried out in a displacement register if the detection is made before the detected piece has arrived in the varnishing zone, or before it has been placed upon the drum 10.

Figure 6:
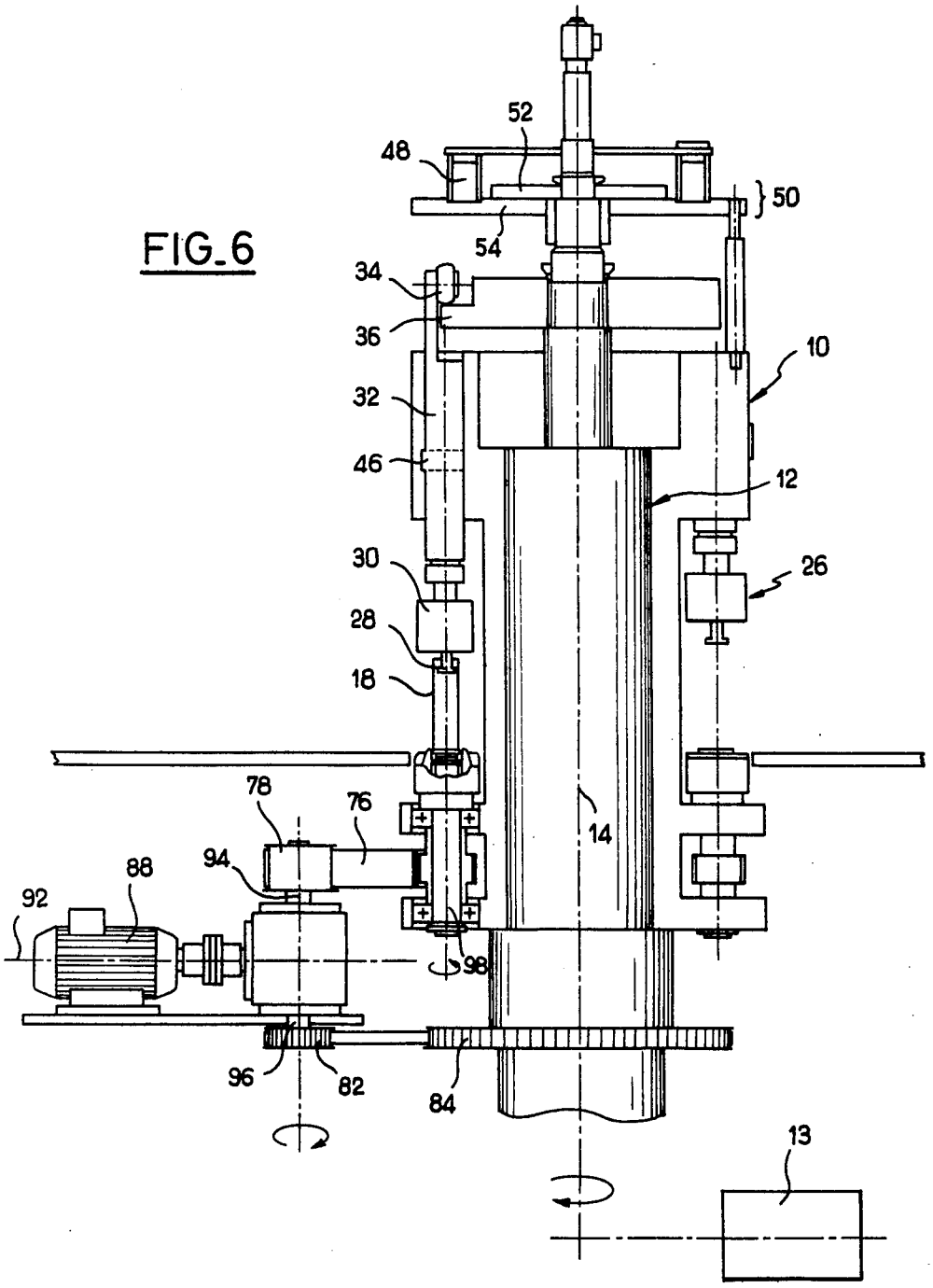
FIG. 6 is a view similar to FIG. 5 of a second embodiment of machine in accordance with the invention, said second embodiment incorporating a different means for rotating the work pieces about their axes.

FIG. 6 shows a machine which, in essence, corresponds to that of FIGS. 4 and 5 in which each work piece 18 is mounted for rotation about its own axis with respect to the drum 10 through the intermediary of a pin or stub shaft 98, mounted for rotation about its own axis with respect to the drum 10, the axis of the stub shaft 98 being parallel to the axis 14 of the drum, the work piece mounted upon such stub shaft being coaxial thereof. Each stub shaft 98 occupies the same position upon the drum 10 which is occupied by the stations 16 in the embodiment of FIGS. 1 and 5, inclusive. Instead of having the work pieces 18 in frictional driving engagement with a continuous belt 76 as in the embodiment of FIGS. 1 to 5 incl., it is the stub shaft 98 which is in driving frictional contact with the belt 76 in the embodiment of FIG. 6. It is to be understood that in FIG. 6 the same elements and particularly the same means for driving the belt 76 are employed as in FIGS. 4 and 5, and are designated by the same reference characters; the manner of operation of the machine illustrated in FIGS. 4 and 5 apply equally to that shown in FIG. 6 with the exception, of course, that the belt 76 does not directly engage the work pieces 18 in order to drive them frictionally, but instead the belt engages a pulley on the stub shaft 98.

However, the means for driving the belt 76 described with reference to FIGS. 1 to 3, incl., may also be employed in the machine of FIG. 6, and the manner of construction and operation of the machine shown in FIGS. 1 to 3, incl., apply equally to the machine shown in FIG. 6, in which the belt 76 frictionally engages and drives stub shafts which form supports for the work pieces 18 as is shown in FIG. 6.

Although the invention is illustrated and described with reference to a plurality of embodiments thereof, it is to be expressly understood that it is in no way limited to the disclosure of such preferred embodiments but is capable of numerous modifications within the scope of the appended claims.

We claim:

1. In a machine for the continuous deposition of a coating upon work pieces in the form of bodies of revolution, said machine having a rotary drum provided on its periphery with a plurality of stations to receive the bodies of revolution, and with a coating zone, as well as a feeding station, and means for driving the rotary drum, the machine being adapted to carry out a coating operation upon the work pieces while they are located in the coating zone, such coating zone forming a fixed angular sector around the drum, means mounting the work pieces for free rotation about their axes at least in the coating zone, a guiding guard mounted externally of the drum and having a fixed portion which frictionally drivingly rotates the work pieces in their travel on the drum as the drum rotates, the improvement wherein the guiding guard is constituted in the coating zone by an endless belt which substantially follows the periphery of the drum, and comprising means separate from the means which rotatably drives the drum for driving the endless belt to impart to the work pieces rotation about their axes by frictionally driving the work pieces by the belt, the means for driving the endless belt driving it at a speed such that when the drum is stopped, the belt drives the work pieces at a speed near that at which they would have been frictionally driven by the fixed portion of the guiding guard if the drum were rotating at its normal speed.

2. A machine according to claim 1, wherein the direction of linear travel of the endless belt is opposite to the direction of feeding of the work pieces by the drum through the coating zone, and the speed of translation of the belt is constant and such that the speed of rotation of the work pieces by the belt alone, the drum being stopped, is at least equal to the speed of rotation of the work pieces upon themselves by reason of being driven by the drum only turning at a normal speed and by reason of the friction between the work pieces and a fixed portion of the guiding guard.

3. A machine according to claim 1, wherein the direction of linear travel of the endless belt is the same as that of the direction of travel of the work pieces with the drum through the coating zone, and the speed of translation of the endless belt is constant and such that the speed of rotation of the work pieces around their axes due only to their being driven by the belt, the drum being stopped, is at least twice the speed of rotation of the pieces around their own axes by reason of being driven by the drum when the drum turns at its normal speed and by reason of friction between the work pieces and a fixed guiding guard.

4. A machine according to claim 1, wherein it comprises a command logic which detects the stopping of the driving means for the drum and assures the automatic transition of the driving speed of the endless belt between a slow speed, when the drum is rotating, and a rapid speed when the drum is stopped, in such manner as to obtain the same speed of rotation of the work pieces with respect to the drum in both of such modes of operation.

5. A machine according to claim 1, wherein it comprises a slave mechanism which assures a constant speed of rotation of the work pieces with respect to the drum as well as the speed of rotation of the drum.

6. A machine according to claim 5, wherein the driving means which assures the rotation of the work pieces is affixed to the first branch shaft of a differential gear mechanism the main shaft of which is driven by an independent prime mover, and the second branch shaft of which is connected to the drum for rotation therewith, the various elements which interact to assure the rotation of the work pieces being so constructed and arranged that the speed of rotation of the work pieces with respect to the drum is independent of the speed of rotation of the drum.

7. In a machine for the continuous depositing of a coating upon work pieces in the form of bodies of revolution, the machine including a rotatable drum provided on its periphery with a plurality of stub shaft supports for the work pieces, and a coating zone which is a fixed sector about the axis of the drum, means for driving the rotary drum, each stub shaft being adapted to support and rotate a work piece about its axis, the machine being adapted to carry out a coating operation during which the bodies of revolution are located in the coating zone, freely rotating stub shafts at least in the coating zone, a guiding guard disposed exterior of the drum and having a fixed portion against which the stub shafts are thrust, the improvement wherein the guiding guard is constituted at least in the coating zone by an endless belt substantially following the periphery of the drum, and comprising means separate from the means which rotatably drives the drum for driving the belt in such manner as to impose upon the stub shafts a rotational movement by reason of friction therewith, said last named means being so constructed and arranged that the belt is driven at a speed which, when the drum is stopped, drives the stub shafts rotatably about their own axes at the same angular speed as that at which they are driven by their engagement with the fixed portion of the guiding guard when the drum is turning at a normal speed.

8. A machine according to claim 7, wherein the direction of linear travel of the belt is opposite to the direction of movement of the stub shafts through the coating zone, and the speed of translation of the belt is constant, and is such that the speed of rotation of the stub shafts by reason of their being driven by the belt only, when the drum is stopped, is at least equal to the speed of revolution of the stub shafts around their own axes by the drum alone turning at its normal speed and by the frictional engagement of the stub shafts with a fixed guiding guard.

9. A machine according to claim 7, wherein the direction of linear travel of the belt is the same as the direction of feeding of the stub shafts through the coating zone, and the speed of translation of the belt is constant and such that the speed of revolution of the stub shafts about their own axes due only to their being driven by the belt, when the drum is stopped, is at least twice the speed of rotation of the stub shafts about their own axes due to their being driven only by the drum turning at its normal speed and by the frictional engagement between the stub shafts and a fixed guard.

10. A machine according to claim 7, comprising a control logic detecting the stoppage and the starting of the drum and assuring the automatic transition of the speed of driving of the belt between a slow speed when the drum is rotating, and a rapid speed when the drum is stopped, in such manner as to obtain the same speed of rotation of the stub shafts with respect to the drum in such two modes of operation.

11. A machine according to claim 7, comprising at least a slave mechanism assuring a constant speed of rotation of the stub shafts with respect to the drum, as well as the speed of rotation of the drum.

12. A machine according to claim 11, wherein the driving means assuring the rotation of the stub shafts is fixed to a first branch shaft of a differential of which the main shaft is driven by an independent prime mover and of which the second branch shaft is connected to rotate in synchronism with the drum, the various elements which interact to assure the rotation of the stub shafts being so constructed and arranged that the speed of their rotation with respect to the drum is independent of the speed of rotation of the drum.

* * * * *